United States Patent [19]

Troncoso

[11] Patent Number: 5,070,855

[45] Date of Patent: Dec. 10, 1991

[54] ARCHERY ARROW REST ASSEMBLY WITH MICRO-ADJUST LATERAL DISPLACEMENT CAPABILITY

[75] Inventor: Vincent F. Troncoso, Montrose, Colo.

[73] Assignee: Golden Key Futura, Inc., Montrose, Colo.

[21] Appl. No.: 631,938

[22] Filed: Dec. 21, 1990

Related U.S. Application Data

[63] Continuation-in-part of Ser. No. 488,949, Feb. 12, 1990, abandoned.

[51] Int. Cl.[5] ..... F41B 5/00

[52] U.S. Cl. ..... 124/44.5; 124/24.1

[58] Field of Search ..... 124/44.5, 24.1, 41.1

[56] References Cited

U.S. PATENT DOCUMENTS

| | | | |
|---|---|---|---|
| 3,292,607 | 12/1966 | Hoyt, Jr. . | |
| 4,324,221 | 4/1982 | Peck . | |
| 4,476,846 | 10/1984 | Carville | 124/44.5 |
| 4,489,704 | 12/1984 | Troncoso, Jr. | 124/44.5 |
| 4,686,956 | 8/1987 | Troncoso, Jr. | 124/44.5 |
| 4,748,964 | 6/1988 | Troncoso, Jr. | 124/44.5 |
| 4,809,670 | 3/1989 | Simo | 124/24.1 X |
| 4,838,237 | 6/1989 | Cliburn | 124/44.5 |
| 4,917,072 | 4/1990 | Chaney | 124/44.5 |

*Primary Examiner*—Peter M. Cuomo

*Attorney, Agent, or Firm*—Donald E. Nist

[57] ABSTRACT

The rest includes an arrow-holding support or blade, a transverse bar, one end of which is connected to the rear of the blade for holding the blade in the window, and a forwardly-rearwardly extending mounting block. The mounting block rear end slideably receives the opposite free end of the cross-bar which passes through it. An externally threaded sleeve is fixedly connected to the free end of the cross-bar and an internally threaded sleeve with turn knob is secured over the externally threaded sleeve for rotation therearound. A coiled spring is over the cross-bar between the mounting block and blade-receiving end of the cross-bar to bias the cross-bar away from the mounting block. When the knob is incrementally rotated, the cross-bar and blade travel incrementally laterally away from or toward the mounting block. The knob may bear grooves and be releasably pinned in place by a set screw, and a clacker wire can be mounted on a block on the cross bar and extend to the turn knob, so that as the turn knob is rotated, the wire clacks over the grooves, giving audible and tactile evidence of the position of the knob. The sleeves, clacker wire, and spring can be mounted on any rest supported by a transverse cross-bar and rear-extending mounting block. The rest may also be biased by a wire from the mounting block through the clacker wire.

10 Claims, 1 Drawing Sheet

ARCHERY ARROW REST ASSEMBLY WITH MICRO-ADJUST LATERAL DISPLACEMENT CAPABILITY

This application is a Continuation-in-Part of application Ser. No. 07/488,949, filed 2/12/90, now abandoned.

BACKGROUND OF THE INVENTION

1. FIELD OF THE INVENTION

The present invention generally relates to archery equipment and more particularly to an improved type of archery arrow rest having the ability to be adjust laterally in micro increments.

2. Prior Art

There are various types of arrow rests available for use in archery bows. The rests are mounted for use in the window defined in the bow by the handle riser sidewall and the arrow shelf. Certain of the rests are merely screwed or pasted to the window sidewall. Certain others of the rests are suspended in the arrow window away from the sidewall in order to provide desired arrow clearance, that is, to prevent the arrow from striking the sidewall and being deflected after it is shot from the bow.

One preferred manner of suspending the arrow rest in the archery bow window is to support the rear end of the rest, that is, the rear of the blade constituting the arrow support, on a transversely extending cross- bar which passes behind the arrow window and which is slidingly received within a rearwardly extending mounting block connected to the riser sidewall. The lateral position of the rest in the window is controlled by pinning the cross-bar in the mounting block ,as by a set screw or the like. When it is desired to move the rest laterally, as when adjusting the rest for better arrow flight, the set screw is loosened and the cross-bar is slid in the desired direction and the set screw is then retightened.

All this is an imprecise way of adjusting the lateral position of the rest, where precision adjustment may be required in order to optimize arrow flight. Moreover, no means are normally provided for checking the position of the rest to make sure it has not slipped closer to or farther away from the window sidewall.

There remains a need for means for precisely and controllably adjusting the lateral position of an arrow rest in an arrow window and for converting arrow rests not having such precise control means to ones which have. Such means should be simple, highly adaptable and provide precise visual, tactile and audible cues for checking and rechecking the exact position of the arrow rest in the window. Such means should be durable, inexpensive and be fabricated of readily available components.

SUMMARY OF THE INVENTION

The improved assembly of the present invention and the improved arrow rest laterally adjusting means of the present invention satisfy all the foregoing needs. The assembly and lateral adjusting means are substantially as set forth in the Abstract of the Disclosure.

Thus, the assembly includes an arrow rest having an arrow-holding support or blade, a transverse bar, one end of which is connected to the rear of the blade for holding the blade in the arrow window and a forwardly-rearwardly extending mounting block. The rear end of the mounting block slideably receives the opposite free end of the cross-bar which passes therethrough and extends away from the blade.

The lateral micro-adjusting means includes an externally threaded sleeve which is fixedly connected to the free end of the cross-bar, that is, the end away from the blade, and an internally threaded sleeve with enlarged turn knob which is rotatably received over the first-named sleeve. A coiled spring is over the cross bar between the mounting block and the blade-receiving end of the cross-bar to bias the cross-bar away from the mounting block.

When the knob is turned, the cross-bar and blade travel incrementally away from or toward the mounting block. The knob bears grooves and is releasably pinnable in position by a set screw. A clacker wire is mounted on a block rigidly secured to the cross-bar and extends into contact with the grooves in the turn knob perimeter. As the knob is turned, the wire clacks audibly and gives out tactile vibrations to aid in positioning and repositioning the rest laterally in the window to a desired position.

It will be understood that the lateral micro-adjusting means described above can be easily fitted to any arrow rest assembly having a slideable cross-bar held in and passing through a rearwardly extending mounting block. In the event that the rest is biased by a spring against depression during shooting, the biasing spring can be connected to the clacker wire, rather than having to pin it directly to the cross-bar. That is an added convenience provided by the assembly and micro-adjusting means of the present invention. The assembly and means can be fabricated of any suitable materials, preferably metal for durability.

Various other features of the improved assembly and micro-adjusting means of the present invention are set forth in the following detailed description and accompanying drawings.

DRAWINGS

DETAILED DESCRIPTION

FIGS. 1–4 and 6

Figure 1:
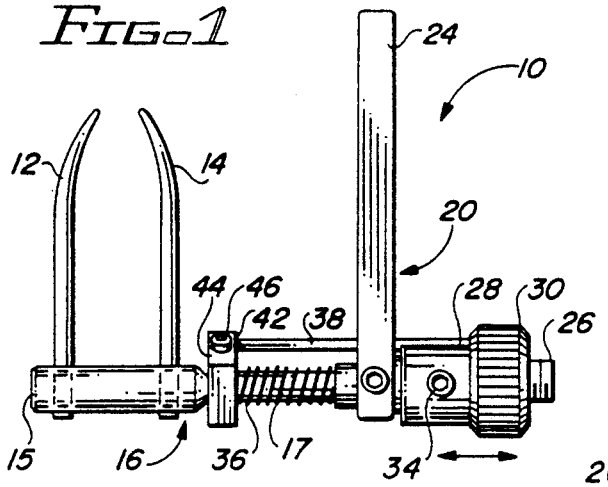
FIG. 1 is a schematic top plan view of a first preferred embodiment of the improved arrow rest of the present invention bearing the improved lateral micro-adjusting means of the present invention.
Figure 3:
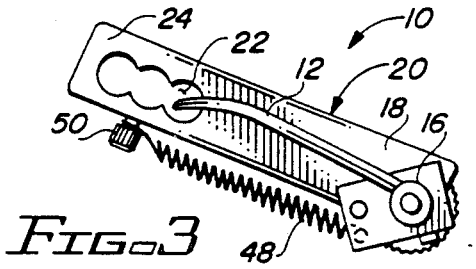
FIG. 3 is a schematic side elevation of the assembly of FIG. 1 showing the side thereof which bears the arrow-supporting blade.
Figure 4:
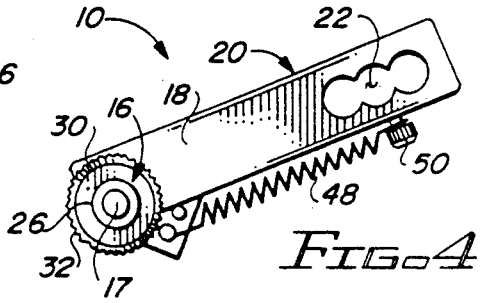
FIG. 4 is a schematic side elevation of the assembly of FIG. 1 showing the side thereof which bears the turn knob thereof.
Figure 2:
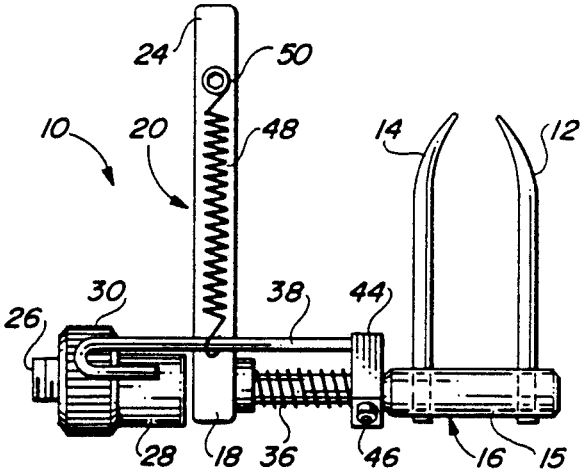
FIG. 2 is a schematic bottom plan view of the assembly of FIG. 1.

Now referring more particularly to FIGS. 1–4 and 6 of the drawings, a first preferred embodiment of the improved arrow rest assembly of the present invention is schematically depicted therein. Thus, assembly 10 is shown which comprises an arrow-supporting pair of spaced blades or tines 12 and 14, the rear ends of which are connected to a one end 15 of a transversely extending cross-bar 16. The opposite end 17 of cross-bar 16 is slideably received within and passes through a transverse opening (not shown) in the rear end 18 of a rectangular mounting block 20, and extends away from blades 12 and 14.

Mounting block 20 has a three lobed opening 22 in the front end 24 thereof through which to pass a connector screw or bolt (not shown) in anchoring end 24 to the sidewall (not shown) of the riser section of an archery bow adjacent the window thereof (not shown). Block 20 is adapted to extend rearwardly to a point behind the riser section, so that cross-bar 16 also passes behind that riser section.

End 17 of cross-bar 16 has an externally threaded sleeve 26 tapped over and firmly secured thereto and an internally threaded sleeve 28 with integral enlarged turn knob 30 threaded over sleeve 26 for rotation therearound. Turn knob 30 is knurled, that is, has parallel ridges 32 therein and sleeve 28 has a set screw 34 trained thereinto to releasably lock sleeve 28 to sleeve 26 in any given position.

A coiled spring 36 is disposed around cross-bar 16 between end 15 thereof and rear end 18 of mounting block 20 to bias block 20 away from end 15. Sleeve 28 prevents block 20 from slipping from cross-bar 16. As knob 30 is turned, blades 12 and 14 on cross-bar 16 move toward or away from block 20, depending on which direction knob 30 is turned.

In order to make the turning incremental in small controllable increments, an elongated straight wire 38 with a crooked end 40 is provided. The opposite end 42 of wire 38 is anchored in a block 44 releasably secured to cross-bar 16 adjacent end 15 thereof by a set screw 46. Wire 38 extends parallel to cross-bar 16 to a location where crooked end 40 thereof engages ridges 32 of knob 30, so that when knob 30 is turned, audible clicks or clacks are heard, a tactile vibration is set up in knob 30 and resistance to turning is encountered. This enables knob 30 to be easily turned one click at a time to minutely adjust the lateral position of blades 12 and 14 relative to mounting block 20. Since block 20 when attached to an archery bow is in a fixed position, blades 12 and 14 extend upwardly and forwardly into the bow window and their lateral position from the sidewall defining the window is thus easily controlled for maximum arrow tuning and to prevent the arrow from slapping the window when fired therethrough. Once the proper tuned position for blades 12 and 14 is reached by turning knob 30, that position can be locked in place by set screw 34.

Block 44 with screw 46, spring 36, wire 38, sleeves 26 and 28 and set screw 34 all form part of a kit which can be used to convert any arrow rest having a cross-bar such as cross-bar 16 and a mounting block such as mounting block 20 to a micro-adjust rest assembly for laterally positioning the blade or blades of the rest in the arrow window of an archery bow. Preferably, all components of assembly 10, including those of the just-described kit, are of metal such as steel or the like for great durability.

Preferably, blades 12 and 14 are biased into the desired forwardly and upwardly position but are depressible against such bias during shooting of an arrow on blades 12 and 14. For this purpose, an elongated coiled spring 48 may be secured to the underside of end 24 of block 20, as by a screw 50 and the rear of spring 48 can be looped around wire 38. Thus, rotation of cross-bar 16 to a blade up position is limited by wire 38 and rotation of cross-bar 16 to the blade down position is resisted by spring 48. Thus, wire 38 serves as a spring anchor and also a cross-bar 16 rotation limit means, in addition to its other functions.

Accordingly, assembly 10 has improved properties over other rest assemblies, is easy to make up from a standard rest and is durable and efficient.

FIG. 5

Figure 5:
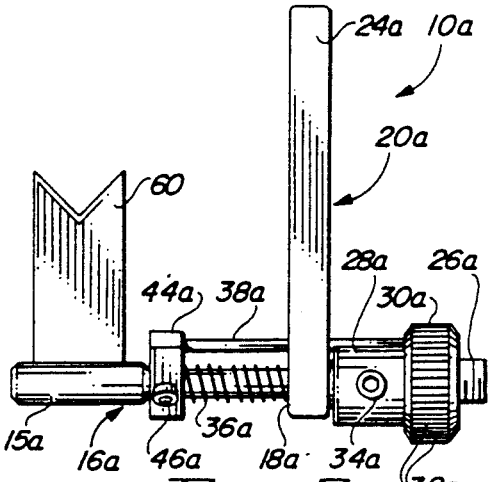
FIG. 5 is a schematic top plan view of a second preferred embodiment of the improved assembly of the present invention; and, FIG. 6 is a schematic side elevation of the components of the lateral micro-adjusting components used in the assembly of FIG. 1.
Figure 6:
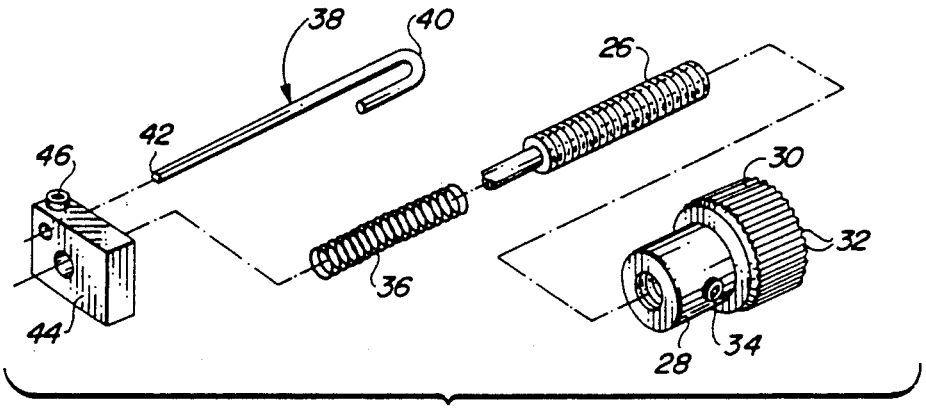

A second preferred embodiment of the improved arrow rest assembly of the present invention is schematically depicted in FIG. 5. Thus, assembly **10*a* is shown. Components thereof similar to those of assembly 10 bear the same numerals but are succeeded by the letter "a". Assembly 10*a* differs from assembly 10** only as follows:

a) flexible resilient blade 60 may be of plastic or thin metal or the like and is used in place of stiff blades 12 and 14;

b) cross-bar **16*a* is not spring biased but instead is held rigid; and, c) wire 38*a* runs through an opening (not shown) extending transversely through block 20*a* and into contact with ridges 32*a* of knob 30*a***.

Assembly **10*a* is substantially identical in function and properties to assembly 10** and illustrates how the previously described kit can be used on rests of various types.

Various modifications, changes, alterations and additions can be made in the improved assembly and kit of the present invention, their components and parameters. All such modifications, changes, alterations and additions as are within the scope of the appended claims form part of the present invention.

It will be particularly noted that in the present device, both tine 12 and tine 14 are independently held in cross-bar 16 and can be adjusted in angle toward each other and in total length, since they extend through end 15 of bar 16. This adjustability is not seen in any other known arrow rest devices, and lends further patentability to the present invention. It will also be noted that the sleeves 26 and 28 with knob 30 can be mounted on any crossbar 16, along with block 44, spring 36 and clacker 38 to provide an arrow rest containing the same with the desired incremental clacker-style lateral adjustability. This is another advance in the art and allows retro-fitting of standard rests.

What is claimed is:

1. An improved arrow rest assembly with micro-adjust lateral displacement capability, said arrow rest assembly comprising, in combination:

a) at least one arrow-holding support or blade;

b) a transverse cross-bar having a free end and an opposite end which is connected to the rear portion of said blade for projecting said blade forwardly into the window of an archery arrow bow, said cross-bar being spring-biased for resilient depression of said blade during shooting of an arrow;

c) a forwardly and rearwardly extending elongated mounting block having a front end and an opposite rear end, said front end being adapted to be secured to the sidewall of the riser section of an archery bow, which sidewall defines said window, and said rear end being adapted to extend rearwardly of said riser section to a position therebehind, said rear end of said mounting block slideably receiving said transverse cross-bar, the free end of which passes therethrough to a point remote from said window; and, d) lateral micro-adjusting means, said means comprising an externally threaded sleeve fixedly secured to said free end of said cross-bar, an internally threaded sleeve bearing an enlarged knurled knob threaded over said externally threaded sleeve for rotational movement relative thereto, and a spring mounted between said mounting block and said blade-receiving end of said cross-bar to bias said cross-bar away from said mounting block, whereby rotation of said knob incrementally moves said blade toward or away from said mounting block to change the lateral position of said blade in said window.

2. The improved assembly of claim 1 wherein said micro-adjusting means includes a stationary block adjustably secured to said cross-bar between said blade and mounting block and which bears one end of a transversly extending clacker wire, the opposite end of which engages said knob, said knob being knurled, whereby rotation of said knob is incremental with audible clacking of said wire and tactile vibration in order to accurately micro-adjust said lateral spacing of said blade.

3. The improved assembly of claim 2 wherein said assembly includes a biasing spring, one end of which is connected to said mounting block and the opposite end of which is connected to said clacking wire.

4. The improved assembly of claim 3 wherein said internally threaded sleeve includes a set screw to releasably hold said knob and control said lateral spacing.

5. The improved assembly of claim 4 wherein a laterally spaced pair of arrow-holding blades are secured to said cross-bar.

6. The improved assembly of claim 5 wherein said blades are curved and of metal and wherein said springs, mounting block, externally and internally threaded sleeves and cross-bar and said clacking wire are of metal.

7. The improved assembly of claim 6 wherein said blades are tines which operate as a unit but are releasably pinned independently to said cross-bar and extend therethrough so that the orientation and length of said tines can be changed.

8. Lateral micro-adjusting means for an archery bow arrow rest having a cross-bar having two opposite ends, a blade-receiving end connected to the rear end of an arrow support blade and a free end slideably received transversely through the rear end of an elongated mounting block having a front end and an opposite rear end, the front end of said block being adapted to be secured to the riser section of an archery bow and the rear end of said block being adapted to extend rearwardly thereof to a point behind said bow, said means comprising, in combination:

a) an externally threaded sleeve adapted to be fixedly secured to the free end of said cross-bar which extends beyond said mounting block and away from said blade;

b) an internally threaded sleeve with enlarged turn knob adapted to be threadably received over said externally threaded sleeve and to rotate therearound; and, c) a coiled spring adapted to be mounted between said mounting block and said blade-receiving end of said cross-bar to bias the cross-bar away from the mounting block, whereby rotation of said knob incrementally moves said blade toward or away from said mounting block for micro-adjusting the lateral position of said blade.

9. The improved means of claim 8 wherein said means includes a stationary block adjustably secureable to said cross-bar between said blade and mounting block and which bears one end of a transversely extending clacker wire, the opposite end of which is adapted to engage said knob, said knob being knurled, whereby rotation of said knob is incremental with audible clacking of said wire and tactile vibration in order to accurately micro-adjust the lateral spacing of said blade.

10. The improved means of claim 9 wherein said means are metal and include a set screw for said internally threaded sleeve.

* * * * *